United States Patent [19]

Hecht

[11] 3,966,016

[45] June 29, 1976

[54] MUFFLER CONVERTER

[76] Inventor: Victor Hecht, 969 Alexander Drive, Haysville, Kans. 67060

[22] Filed: Nov. 15, 1974

[21] Appl. No.: 524,071

Related U.S. Application Data

[63] Continuation-in-part of Ser. No. 351,491, April 16, 1973, abandoned.

[52] U.S. Cl. ..... 181/57; 181/53; 181/61

[51] Int. Cl.[2] ..... F01N 1/08

[58] Field of Search ..... 181/35 C, 49, 53, 54, 181/55, 59, 61, 57

[56] References Cited

UNITED STATES PATENTS

| | | | |
|---|---|---|---|
| 2,166,408 | 7/1939 | Hoyle | 181/53 |
| 2,196,491 | 4/1940 | Chipley | 181/53 |
| 3,103,256 | 9/1963 | Deremer | 181/54 |
| 3,181,647 | 5/1965 | Schomburg | 181/53 |
| 3,315,761 | 4/1967 | Selig | 181/54 |
| 3,353,628 | 11/1967 | Gilbert | 181/53 |
| 3,404,445 | 10/1968 | Crouse | 181/35 C |

*Primary Examiner*—L. T. Hix
*Assistant Examiner*—Vit W. Miska
*Attorney, Agent, or Firm*—John H. Widdowson

[57] ABSTRACT

The invention is a muffler for an internal combuston engine. It has a hollow shell enclosing a hollow casing. An inlet conduit and an outlet conduit are mounted through opposite ends of the shell and the casing. A pair of baffle members are mounted in the cavity in the casing in spaced relation. Each of the baffle members have an aperture. A pair of conduits are rigidly secured to the baffle members and at the apertures thereof and the conduits extend toward the opposite baffle member.

8 Claims, 5 Drawing Figures

MUFFLER CONVERTER

CROSS REFERENCE TO RELATED APPLICATIONS

This application for patent is a continuation-in-part application of my application entitled MUFFLER CONVERTER, filed Apr. 16, 1973 and having Ser. No. 351,491 now abandoned.

BACKGROUND OF THE INVENTION

This invention is related to internal combustion engine muffler structures. More particularly the invention is related to muffler structures which convert products of combustion in the exhaust gases.

Many types of exhaust gas mufflers are noted in the prior art to muffle or reduce the sound emission or noise in the exhaust of an internal combustion engine. These prior art mufflers are designed mainly to reduce the exhaust gas noise of an engine and they make no appreciable contribution toward completing the combustion of unburned hydrocarbon materials normally contained in internal combustion engine exhaust gases. Some exhaust gas conversion devices are known in the art to burn the unburned hydrocarbon materials in the exhaust gases, however these require external power in the form of heat, electrical sparks and so forth. Heretofore devices known in the art which will convert or burn substantially all of the hydrocarbon material in the exhaust gas from an internal combustion engine without the use of an external power source. Also it is to be noted that the prior art devices will not function or will function very ineffectively and inefficiently when an engine is operated at idle speed or a substantially slow speed because the devices require a relatively high gas flow rate for proper operation. No prior art device is known which will function effectively at a low engine speed or with a relatively low velocity exhaust gas flow.

SUMMARY OF THE INVENTION

In the preferred specific embodiments of the muffler converter of this invention a muffler structure is provided having a hollow shell which encloses a hollow casing. A conduit and baffle structure is provided in the casing. An inlet conduit is mounted through the shell and communicably connected to the casing on one end of the structure and an outlet conduit is mounted through the shell and communicably connected with the cavity of the casing on the opposite end of the structure. The baffle arrangement in the casing has a pair of baffle members rigidly mounted in the casing in a spaced relation with each baffle having an aperture therethrough. A pair of conduits are rigidly secured to the baffle members and with one conduit secured to each baffle and the conduits extending toward the opposite baffle member. In use exhaust gases enter through the inlet conduit strike a first baffle member, pass through one conduit into the space between the baffle members and from there pass through the second conduit and on out of the muffler outlet conduit. As the hot exhaust gases move through the passageways of the muffler the baffles and casing structure are substantially heated and they are retained in the heating condition while the engine is in operation. An insulated environment is provided by the hollow casing being enclosed in the hollow shell. This heated environment provides sufficiently high temperature combustion space for the unburned hydrocarbon materials in the engine exhaust gases to be substantially completely burned or converted before they exit the muffler structure through the outlet. The muffler converter structure is provided with refractory surfaces inside the casing to increase their heat retention and radiation characteristics.

One object of this invention is to provide a muffler converter overcoming the aforementioned disadvantages of the prior art devices.

Still, one other object of this invention is to provide a muffler structure which has a hollow casing enclosed in a hollow shell to provide an insulated, high heat environment in a baffled structure in the hollow casing which will function to reduce the noise level in the internal combustion engine exhaust gases and to substantially completely burn unburned hydrocarbon materials and convert products of combustion contained in exhaust gases to substantially reduce the objectionable exhaust gas emissions of internal combustion engines.

Still, one other object of this invention is to provide a muffler converter structure having a hollow shell with a hollow casing enclosed in the hollow shell in a spaced relation thereto with a baffled structure inside the hollow casing. The baffled structure preferably has a pair of baffle members rigidly mounted in the casing in a spaced relation with each baffle having an aperture therethrough and each baffle having a conduit secured thereto and extending toward the other baffle member.

Yet, another object of this invention is to provide a muffler converter structure usable in an exhaust system having a header conduit from the exhaust manifold of an internal combustion engine to the muffler wherein the header conduit is enclosed in a casing conduit and the muffler is insulated by a hollow shell around a hollow casing.

Yet, another object of this invention is to provide a muffler converter structure for the exhaust gas system of an internal combustion engine wherein the header conduit from the exhaust manifold of an engine is insulated by a dead air space which is communicably connected with a dead air space around the muffler structure.

Various other objects, advantages, and features of the invention will become apparent to those skilled in the art from the following discussion, taken in conjunction with the accompanying drawing, in which:

FIG. 1 is an elevation view of an exhaust system employing the muffler converter structure of this invention. The outlet end portion of an internal combustion engine exhaust manifold is connected to the header conduit which is connected to the muffler converter, which is connected by a conduit to a conventional sound attenuating muffler, which is in turn connected to a tailpipe or the like that has an outlet. A portion of a casing conduit around the header conduit is cut away for clarity;

FIG. 2 is a cross sectional view of a specific embodiment of the muffler converter of this invention and a portion of a header conduit;

FIG. 4. is a partially cut away elevation view of a specific embodiment of the muffler converter of this invention connected to a portion of a header conduit;

Figure 1:
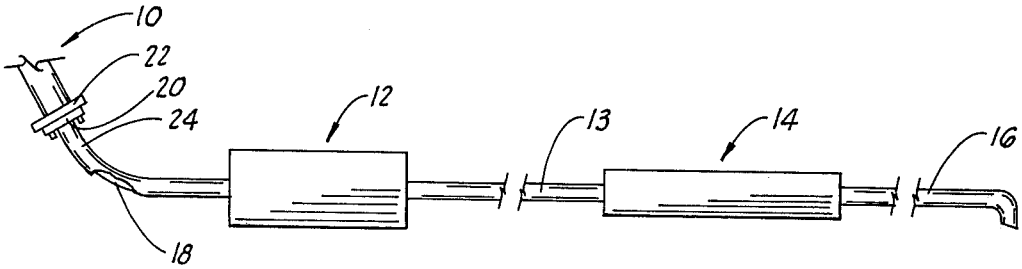

The following is a discussion and description of preferred specific embodiments of the muffler converter structure of this invention, such being made with reference to the drawing whereupon the same reference numerals are used to indicate the same or similar parts and/or structure. It is to be understood that this discussion and description is not to unduly limit the scope of the invention.

DESCRIPTION OF PREFERRED EMBODIMENTS

Referring to the drawing in detail and in particular to FIG. 1 which illustrates an exhaust system for a vehicle such as an automobile, truck or any other installation of an internal combustion engine. The exhaust system includes an exhaust manifold 10 on the engine which collects the exhaust gases from the cylinders of the engine, a conduit from the exhaust manifold 10 to the muffler converter, indicated generally at 12, which is in turn connected by a conduit 13 to a conventional sound attenuating muffler, indicated at 14, which has an outlet that is connected to a tailpipe conduit 16. In a conventional exhaust system the exhaust manifold 10 is connected directly to a conventionally styled muffler, which is connected to the tailpipe. The exhaust system of this invention has the muffler converter of this invention inserted in the conduit between the exhaust manifold and the conventionally styled muffler. The conduit that is connected to the exhaust manifold is commonly referred to as a header pipe or header conduit 18 and it has a flange 20 on its inlet end portion which is coupled with a corresponding flange 22 on the outlet end portion of the exhaust manifold 10. The header conduit 18 of this invention is enclosed in a casing conduit 24. The casing conduit 24 is spaced from the header conduit 18 to provide an air gap or dead air space completely around the header conduit 18. The casing conduit 24 is secured to the header conduit 18 or the flange 20 at its inlet end portion to seal the dead air space at that end. The outlet end portion of the header conduit 18 and conduit casing 24 will be described hereinafter.

Figure 2:
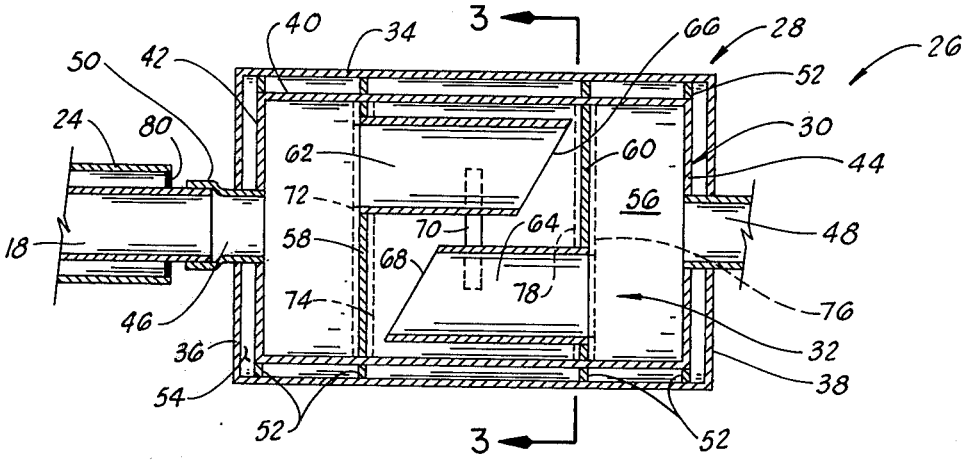

FIG. 2 shows an embodiment, (1) of the muffler converter of this invention. This embodiment, (1), is indicated generally at 26 and includes a hollow outer shell, indicated generally at 28. The hollow shell 28 encloses a hollow casing, indicated generally at 30 that encloses a baffle and conduit structure indicated generally at 32. The hollow shell 28 has a sidewall 34 with ends 36 and 38 rigidly secured to the sidewall. The hollow casing 30 has a sidewall 40 with opposed ends 42 and 44 rigidly secured thereto. The sidewalls 34 and 36 of the shell 28 and the casing 30, respectively, are preferably cylindrical and have an elongated, substantially oblong or elliptical cross section. An inlet conduit 46 extends through the shell end 36 and through the casing end 42. An outlet conduit 48 extends through the shell end 38 and through the adjacent casing end 44. The inlet conduit 46 and outlet conduit 48 are preferably rigidly secured to the ends of the shell 28 and the casing 30 for structural support and to effectively seal the structure. The inlet conduit 46 is provided with an enlarged inlet end portion 50 to receive and mount the header conduit 18. A plurality of lugs or spacer members, indicated at 52, are secured to the inside of the shell sidewall 34 and to the outside of the casing sidewall 40 to maintain them in a spaced relation. The space between the sidewalls 34 and 40 provides a dead air space or a cavity indicted at 54. The spacer members 52 are provided at spaced intervals around the sidewalls 34 and 40 in order to support the shell structure 28 in the spaced relation from the exterior of the casing 30 and to allow for free movement of air in the dead air space 54.

Figure 3:
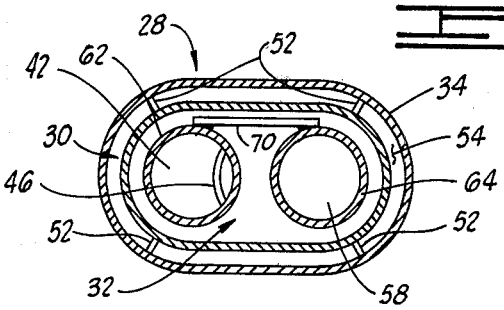
FIG. 3 is a cross sectional view of the muffler converter shown in FIG. 2, with the view taken on line 3—3 of FIG. 2.

The interior of the casing 30 defines a cavity, indicated generally at 56 which encloses the baffle and conduit structure 32. The baffle and conduit structure 32 is comprised of a first baffle member 58 and a second baffle member 60, a first conduit 62 secured to the first baffle member 58, and a second conduit member 64 secured to a second baffle member 60. The first baffle member 58 is the one closest to the inlet conduit 46. The first baffle member 58 has an aperture through one end portion with the first conduit member 62 being ridigly secured to the baffle member at the aperture. The first conduit member 62 extends from the baffle member 58 toward the second conduit member 60. The outlet end 66 of the first conduit member 62 is preferably cut to lie in a plane that is angularly oriented relative to the elongated axis of the conduit member 62 so the outlet of the first conduit member 62 is directed toward the second baffle member 60 and the second conduit member 64. FIG. 2 clearly illustrates the angular disposition of the first conduit outlet end 66 in relation to the baffle structure, particularly the second baffle member 60 and second conduit member 64. The second baffle member 60 has an aperture in one end portion which is disposed on the opposite side of the muffler from the aperture in the first baffle member 58. The second conduit member 64 is rigidly secured to the second baffle member 60 at the aperture and it extends toward the first baffle member 58. The outlet end of the second conduit member 64 is preferably cut to lie in a plane that is angularly oriented relative to the elongated axis of the conduit member 64 so that the outlet of the second conduit member 64 is directed toward the first baffle member 58 and the first conduit member 62. FIG. 2 clearly illustrates the angular disposition of the second conduit's outlet end 68. Preferably the first conduit member 62 and the second conduit member 64 are arranged in an essentially parallel and spaced relation as shown in FIGS. 2 and 3 with the outlet end portions of the conduits arranged in an overlying, spaced, and adjacent relationship. The outlet end of the conduit members 62 and 64 terminates in proximity to the baffle members 60 and 58 respectively. The conduit members 62 and 64 are connected by a brace member 70 for structural support in an overlapping midportion thereof.

In use exhaust gases flow through the inlet conduit 46 into the inlet end portion of cavity 56 whereupon the hot exhaust gases circulate therein and move over baffle 58 into and through conduit 62. The exhaust gases exit the conduit 62 through the end 66 whereupon they contact baffle member 60 and the attached end of conduit 64 and circulate in the center portion of cavity 56 surrounding the conduit members 62 and 64. Next, the exhaust gases enter conduit 64 through the end 68 and pass into the outlet portion of cavity 56 whereupon they circulate therein and pass through the outlet conduit 48 out of the muffler converter structure 26.

In the construction of the muffler converter 26 the baffle structure 32 can be modified if desired to increase the heating characteristics. The casing 30 and baffle structure 32 can be constructed of a metallic material such as copper, steel, stainless steel and others which will have good heat conducting and radiating characteristics when exposed to the hot exhaust gas flow. An alternative construction is illustrated in dashed lines in FIG. 2 wherein the first baffle member 58 and the second baffle member 60 are coated with a refractory type material. The coating on baffle member 58 is indicated at 72 and 74 with the coatings substantially completely covering the exposed sides thereof. The coating on baffle member 60 is indicated at 76 and 78 wherein the coating substantially completely covers both exposed sides of the baffle. The specific refractory material coating for the baffle members 58 and 60 is preferably selected from known refractory materials which can be easily heated by the hot exhaust gases and will maintain a high heat on the surface thereof. Refractory material in general includes numerous specific materials such as fireclays, plastics, ceramics and porcelains. A refractory material usable in the muffler converter of this invention would preferably have a good resistance to slagging and spalling. Also it would have to have a thermal coefficient of expansion compatable with other materials in the muffler converter structure. The heated surfaces of the refractory material will greatly enhance the heating and heat or radiating characteristics of the baffle structure 32. An alternate construction to that mentioned heretofore is to construct the baffle and conduit structure 32 and the casing 30 if desired solely from a refractory material to further enhance the heating characteristics of the muffler converter. It is believed that a construction of ceramic refractory material would be of important significance because of the inherent heat carrying, transmitting and holding characteristics of refractory materials generally. In actual practice the muffler converter structure as shown in FIG. 2 has been constructed and used with same constructed from a relatively mild steel wherein it produced excellent results in regard to heating of the baffle structure 32 and completing the combustion of unburned hydrocarbon materials, etc. in the engine exhaust gases.

When the muffler converter 26 of this invention is connected in an exhaust system as shown in FIG. 1 the header conduit 18 is secured in the enlarged portion 50 of the inlet conduit 46. The header casing 24 has an end member 80 secured thereto and secured to the exterior of the header conduit 18 to seal the dead air space around the header conduit 18. The dead air space around the header conduit 18 functions to insulate the header conduit thereby maintaining the exhaust gases carried by the header conduit in a substantially elevated temperature condition from the point where they leave the exhaust manifold 10 to the point where they enter the muffler converter. Insulating the header conduit 18 is an important feature of the overall muffler converter system of this invention because it insures that hot exhaust gases will reach the muffler converter to supply the heating necessary for the combustion of the unburned hydrocarbon materials, etc. in the exhaust gases. When the muffler converter 26 is in use the hot exhaust gases enter the inlet conduit 46 from the header conduit 18 and heat the baffle and conduit structure 32 as described above, then flow out through the outlet conduit 48. Downstream of the muffler converter 26 a conventional sound attenuating muffler can be connected if desired, to further reduce the engine exhaust noise for a specific installation. Because the baffle and conduit structure 32 is heated by the hot exhaust gases the casing 30 is also considerably heated. The heated casing and its contents are insulated from the external environment by the shell 28 and the dead air space in the cavity 54 surrounding the casing 30. The insulating structure formed by the shell 28 and the dead air space 50 allow the casing 30 and its contents to be kept at a relatively high operating temperature by the engine exhaust gases as they flow through the muffler converter structure. It is this insulation characteristic of the muffler converter which allows it to maintain the high temperatures necessary for combustion of the hydrocarbon materials, etc. in the exhaust gases during substantially all operating conditions and particularly when the flow rate through the muffler converter is relatively low, such as when an engine is idling.

Figure 5:
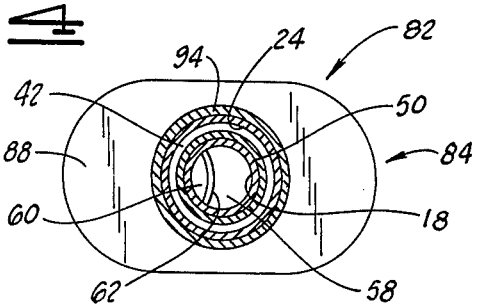
FIG. 5 is an end elevation view of the muffler converter shown in FIG. 4 with the view taken on line 5—5 of FIG. 4.

Another embodiment, (2) of the muffler converter of this invention is shown in FIGS. 2 and 5 wherein the muffler converter is indicated generally at 82. The muffler converter structure 82 includes a hollow shell 84 enclosing a casing that has a baffle and conduit structure therein. The casing and baffle structure are identical to that described above and for that reason they bear similar numerals for identification purposes. The structure of the right hand side or outlet end portion of the shell, casing, and baffle structure of the muffler converter 82 is structurally the same as the right hand portion of FIG. 2. The right hand portion of FIG. 3 is shown with the shell and casing sidewalls to illustrate their external appearance. The casing 30 includes the baffle and conduit structure 32 in the cavity 56 thereof with the baffle structure consisting of the conduits 62 and 64 mounted on the baffles 58 and 60 as described above. The casing 30 has a sidewall 40 with end walls 42 and 44. The inlet conduit 46 is connected with the casing end wall 42 and the outlet conduit 48 extends through the shell 84 and is connected with the casing end 44. The shell 84 includes a sidewall 86 with end members 88 and 90 on the opposite ends thereof. Spacer members 52 are secured between the interior of the shell sidewall 68 and the casings 30 to support the casing 30 in a spaced relation from the shell 84. In the outlet end portion of the muffler converter structure 82 the casing end 90 is secured to the outlet conduit 48 the same as that shown in FIG. 2. In the inlet end portion of the muffler converter structure 82 the perimeter of the shell end 88 is secured to the shell sidewall 68 and in the center portion of the end 88 a conduit 92 extends outward from the end 88 around the inlet conduit 46. The extreme inlet end portion of the conduit member 92 is enlarged as shown to accept the header casing conduit 24. The dead air space between the shell 84 and the casing 30 is indicated at 96. This dead air space 96 includes the space portion surrounding the inlet conduit member 46 inside of the conduit member 92 and the space between the casing 30 and the shell 84.

When the muffler converter 82 of this invention is mounted in an exhaust system such as shown in FIG. 1 the inlet conduit 46 is connected with the header conduit 18, the conduit 92 is connected with the header casing conduit 24, and the outlet conduit 48 is connected with the exhaust conduit 13 leading to the muffler 14. The dead air space surrounding the header conduit 18 is communicably connected in open fluid communication with the dead air space 96 in the muffler converter 82. Because these dead air spaces are connected the air contained therein can circulate in free motion about the casing and the header conduit 18. Motion of the air in this dead air space is caused by heating of the header conduit and the casing structure by the hot exhaust gases. Because the air is free to flow in this dead air space it can circulate and maintain the entire header conduit 18 and casing structure 30 in an elevated temperature environment. This environment is believed to promote the heat holding and generating characteristics of the baffle and conduit structure and casing structure and to further increase the operative function of the muffler converter of this invention. In use the muffler converter 82 functions the same as the muffler converter 26 as described above in regard to heating of the baffle members and the flow of the hot exhaust gases through the structure with the same overall result.

Figure 4:
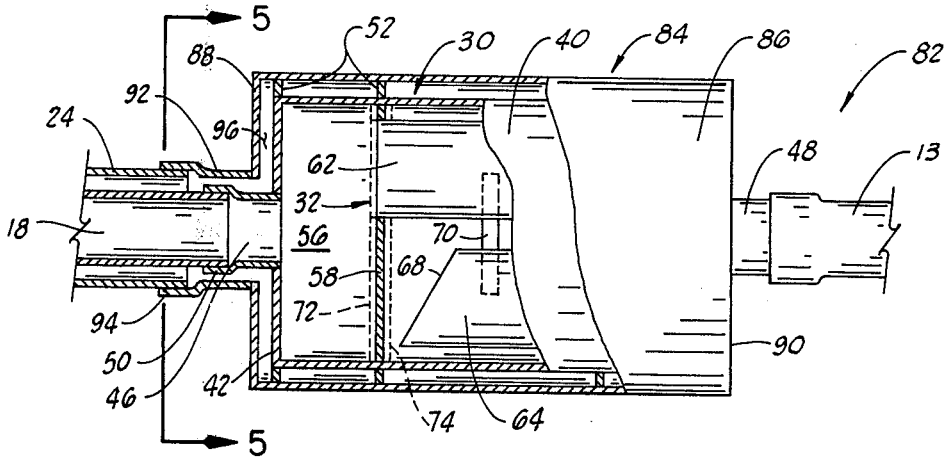

It is to be noted that the muffler converter 82 can be constructed with modifications if desired in respect to the casing 30 and baffle structure 32. Both baffle members can be coated with a refractory type material as indicated at 72 and 74 on the visible baffle member 58 in FIG. 4. Both baffle members can be coated with a refractory material selected from refractory materials as described above which will cause the surface to maintain and radiate a substantial quantity of heat when exposed to the hot exhaust gases. In another construction, the baffle structure 32 and the casing 30, if desired, can be formed completely from a refractory material to further increase the heating characteristics of the muffler converter. In practice, the muffler converter 82 can be constructed of metallic material such as steel, stainless steel, copper, and so forth which have good heat radiating characteristics and will in use function to radiate sufficient heat to substantially complete the combustion process for the unburned hydrocarbon materials in the internal combustion engine exhaust gases.

The muffler converter of this invenion is adapted for use with internal combustion engines which are designed to burn hydrocarbon fuel, such as gasoline. These hydrocarbon fuels are composed of various families of hydrocarbon compounds. Most liquid hydrocarbon fuels are a mixture of hydrocarbons that are derived from crude oil through distillation and cracking processes, and they are produced in a variety of grades each of which is made up of a large number of different combinations of hydrocarbon elements. The combustion process in an internal combustion engine essentially is an oxidation of a portion of the fuel during a relatively short time and in a compressed state. When the liquid hydrocarbon fuel is burned both carbon and hydrogen are oxidized with the products of combustion including carbon monoxide, carbon dioxide, several compounds of nitrogen, and water with the water being in a vaporous state. The atmosphere normally taken in by internal combustion engines is approximately 20% oxygen and 80% nitrogen, therefore, the products of combustion for an internal combustion engine contain a considerable quantity of oxides of nitrogen. The actual quantity of fuel which is burned in the engine depends upon the specific engine however, as a general rule internal combustion engines do not burn all the fuel which is introduced into them. The exhaust from these engines contains the aforementioned products of combustion along with unburned hydrocarbons or portions of the unburned fuel. The muffler converter of this invention is constructed and adapted to in use provide a high temperature environment in the exhaust gas system which will convert or burn the unburned fuel and convert hydrocarbon compounds in the exhaust gas to further oxidize compounds before they are discharged into the atmosphere.

In the use and operation of the preferred embodiments of the muffler converter structure shown and described herein it is seen that same provides a muffler converter structure for burning unburned fuel and for further converting products of combustion in the exhaust gases of an internal combustion engine. The beneficial effect of the muffler converter of this invention is to reduce the objectionable exhaust gas emissions of an internal combustion engine and at the same time muffle or reduce the exhaust noise of the engine. The muffler converter of this invention is an insulated structure in itself which is used with an insulated header conduit from the exhaust manifold of an engine. The muffler converter is usable with vehicle exhaust systems by replacing the upstream portion of the exhaust system by the structure as shown in the drawings and described herein. It is to be noted that the muffler converter of this invention can be used with both spark ignition and compression ignition engines in vehicles such as automobiles and trucks, in aircraft and in virtually any application of an internal combustion engine.

As will become apparent from the foregoing description of the Applicant's muffler converter structure, relatively simple and easily manufacturable apparatus has been provided to muffle the noise and convert the products of combustion of an internal combustion engine exhaust. The muffler converter structure is simple in construction, thus, it is easily and economically manufacturable. The muffler converter structure can be constructed from materials of the type conventionally used in muffler structure or if desired it can be constructed to include refractory type materials if desired. The muffler converter structure can be easily designed into exhaust gas systems and it can easily be fitted on existing exhaust gas systems by replacing the forward end portion of the exhaust systems.

While the invention has been described in conjunction with preferred specific embodiments thereof, it will be understood that this description is intended to illustrate and not to limit the scope of the invention which is defined by the following claims.

I claim:

1. A muffler for an internal combustion engine exhaust gas system, comprising:

a. a hollow shell having a sidewall and opposite ends, b. a hollow casing enclosed in said hollow shell in a spaced relation thereto, defining a cavity therein, and having a sidewall and opposite ends, c. an inlet conduit mounted through said shell and rigidly mounted to said casing and extending through adjacent ends of said shell and said casing, d. an outlet conduit mounted with said shell and said casing and extending through adjacent ends of said shell and said casing, e. a first baffle member and a second baffle member rigidly mounted with said casing sidewall in said casing cavity in a spaced relation to each other, each of said baffle members having an aperture therethrough with said apertures disposed in a spaced relation, said first baffle member being closest to said inlet conduit, f. a first conduit rigidly secured to said first baffle member, communicably connected with said aperture in said first baffle member and having its unattached end portion extending toward said second baffle member, and g. a second conduit rigidly secured to said second baffle member, communicably connected with said aperture in said second baffle member and having its unattached end portion extending toward said first baffle member, said muffler is constructed and adapted to in use receive exhaust gases from an internal combustion engine through said inlet conduit, pass said exhaust gases through said first conduit into said casing cavity, from said casing cavity through said second conduit and out said outlet conduit.

2. The muffler of claim 1, wherein:

a. said casing is rigidly mounted with said shell to define a dead air space between said shell and said casing with said inlet and outlet conduit extending therethrough said dead air space, b. said first conduit unattached end portion opens toward said second baffle member and said second conduit, and c. said second conduit unattached end portion opens toward said first baffle member and said first conduit.

3. The muffler of claim 1, wherein:

a. said shell has an air space positioned in said shell end having said inlet conduit, said air space being positioned therearound said inlet conduit, said air space acting as a heating conduit, b. said heating conduit being communicably connected with a cavity formed between said shell and said casing.

4. The muffler of claim 1, wherein:

a. said first baffle member is coated with a refractory material, and b. said second baffle member is coated with a refractory material.

5. The muffler of claim 1, wherein:

a. said first baffle member, said second baffle member, said first conduit member and said second conduit member are constructed of a refractory material.

6. The muffler of claim 1, wherein said muffler is mounted in an exhaust system having a header conduit communicably connected from an internal combustion engine to said inlet conduit, and wherein said header conduit is substantially completely enclosed in a conduit casing, and with said exhaust system having a dead air space between said header conduit and said conduit casing.

7. The muffler of claim 3, wherein:

a. said muffler is mounted in an exhaust system having a header conduit communicably connected from an internal combustion engine to said inlet conduit and wherein said header conduit is substantially completely enclosed in a conduit casing having an air space between said header conduit and said conduit casing, and b. said conduit casing is communicably connected to said heating conduit.

8. The muffler of claim 2, wherein:

a. said shell and said casing are elongated in cross section, b. said first conduit and said second conduit are disposed in an adjacent spaced relation with said first conduit unattached end portion being adjacent to a portion of said second conduit, c. said first conduit unattached end portion has the end thereof in a plane that is angularly oriented relative to said first conduit, and d. said second conduit unattached end portion has the end thereof in a plane that is angularly oriented relative to said second conduit.

* * * * *